US006182629B1

(12) United States Patent
Gobbels et al.

(10) Patent No.: US 6,182,629 B1
(45) Date of Patent: Feb. 6, 2001

(54) METHOD OF MAKING A CYLINDER LINER

(75) Inventors: Franz-Josef Gobbels, Burscheid; Werner Trubenach, Obergriesbach; Peter Godel, Freienried; Manfred Fischer, Leichlingen; Markus Müller, Burscheid, all of (DE)

(73) Assignee: Federal-Mogul Burscheid GmbH, Burscheid (DE)

( * ) Notice: Under 35 U.S.C. 154(b), the term of this patent shall be extended for 0 days.

(21) Appl. No.: 09/411,200

(22) Filed: Oct. 4, 1999

(30) Foreign Application Priority Data

Oct. 2, 1998 (DE) ..... 198 45 347

(51) Int. Cl.[7] ..... F02F 1/18
(52) U.S. Cl. ..... 123/193.2; 29/888.061
(58) Field of Search ..... 123/193.2, 193.4, 123/193.1; 29/888.061; 427/446

(56) References Cited

U.S. PATENT DOCUMENTS

| | | | | |
|---|---|---|---|---|
| 3,165,983 | | 1/1965 | Thomas . | |
| 3,276,082 | | 10/1966 | Thomas . | |
| 5,829,405 | * | 11/1998 | Godel | 123/193.2 |
| 5,958,520 | * | 9/1999 | Cooke et al. | 427/446 |
| 6,044,820 | * | 4/2000 | Domanchuk et al. | 123/193.2 |

FOREIGN PATENT DOCUMENTS

| | | |
|---|---|---|
| 1 282 243 | 7/1969 | (DE) . |
| 2 344 899 | 2/1974 | (DE) . |
| 196 05 946 | 7/1997 | (DE) . |
| 1043913 | 11/1953 | (FR) . |
| 2 413 553 | 7/1979 | (FR) . |

* cited by examiner

*Primary Examiner*—Marquerite McMahon
(74) *Attorney, Agent, or Firm*—Venable; Gabor J. Kelemen

(57) ABSTRACT

A cylinder liner for an internal-combustion engine includes a tubular liner wall having circumferentially spaced thickened wall portions.

1 Claim, 1 Drawing Sheet

METHOD OF MAKING A CYLINDER LINER

CROSS-REFERENCE TO RELATED APPLICATION

This application claims the priority of German Application No. 198 45 347.7 filed Oct. 2, 1998, which is incorporated herein by reference.

BACKGROUND OF THE INVENTION

The invention relates to a cylinder liner to be inserted into the cylinder bore of an engine block. The liner is made in a free-form method by thermal spraying of a spray material onto a mandrel serving as a mold body to obtain a cylinder wall.

The engine block of an internal-combustion engine typically comprises a cast-iron or aluminum alloy. Cylinder liners are cast in the engine block which is made by a casting method. Wear-resistant metals or metal alloys serve as the material for the cylinder liner which may be manufactured in numerous ways.

A method of producing aluminum cylinders having cast steel liners is disclosed in German Patent No. 12 82 243. First, a steel tube is made by thermal spraying, then inserted, as a separate body, into the metal block. To connect the liner to the cast material, a vacuum is generated in the liner to cause the melted aluminum to penetrate the pores of the steel tube. Multi-layer cylinder liners have been developed to simplify this complex connecting technique. The layer forming the running surface comprises a wear-resistant and scorch-mark-resistant material. An outer cover layer comprising, for example, an aluminum alloy is sprayed onto the layer forming the running surface.

In the casting process for liners of the above-outlined type the liquid engine-block material fuses with the cover layer. German Patent No. 196 05 946, to which corresponds U.S. Pat. No. 5,929,405, discloses such a cylinder liner and a method of producing the same.

It has been found that in complex geometrical configurations of the engine block the hardening process, in conjunction with the shrinkage of the cast material, leads to stresses in the cooled cast piece. This results in considerable distortions in the region of the liner, Because the cylinder liners often require machining after casting, the wall thicknesses of the liners may be partially reduced. During engine operation, these regions represent critical zones in terms of thermal and mechanical stability.

SUMMARY OF THE INVENTION

It is an object of the invention to provide an improved liner of the above-outlined type which prevents the occurrence of distortions during casting or engine operation.

This object and others to become apparent as the specification progresses, are accomplished by the invention, according to which, briefly stated, the cylinder liner for an internal-combustion engine includes a tubular liner wall having circumferentially spaced thickened wall portions.

Cylinder liners according to the invention can be produced with particularly thin walls. The thickened wall portions at the outer circumferential surface of the liner effectively reinforce the stability of the liner so that no distortions occur after casting the material of the cylinder block. The thickened wall portions in the form of ribs can be adapted to the respective application, both in the local arrangement and the number of ribs. A thickened wall portion should preferably be provided at least at three circumferential locations of the liner. The control of the spraying process effects different cross-sectional shapes of the material buildup. Polygonal cross sections can be used in addition to round cross sections. For the rods which form ribs to constitute the thickened wall portions, advantageously cross-sectional shapes are chosen which lend a high bending and/or torsional resistance to the rods.

DESCRIPTION OF THE PREFERRED EMBODIMENTS

Figure 1:
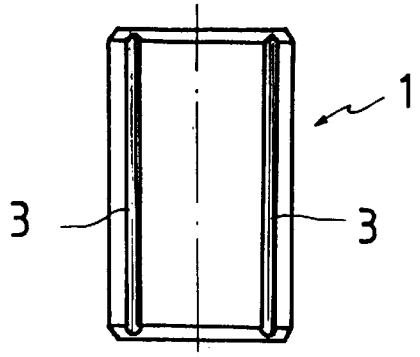
FIG. 1 is an axial sectional view of a cylinder liner according to the invention.

The cylinder liner 1 shown in FIG. 1 is made with a thermal spraying method. Commercially available metal and/or metal-ceramic spray materials can be used.

Figure 2:
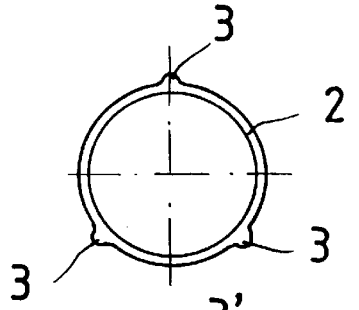
FIG. 2 is a top plan view of a cylinder liner according to FIG. 1.

The cylinder liner 1 has a circumferential cylinder wall 2 (FIG. 2) which has varying wall thicknesses over the circumference. Thus, as shown in FIGS. 2–5, wall-thickness reinforcements 3, 3', 3", 3'" are formed. The wall-thickness reinforcements 3, 3' are preferably ribs which extend over the axial length of the cylinder liner 1. FIG. 2 shows a variant in which the ribs form one-piece components with the cylinder wall 2. This embodiment is simple and inexpensive to produce by varying the spraying parameters.

Figure 3:
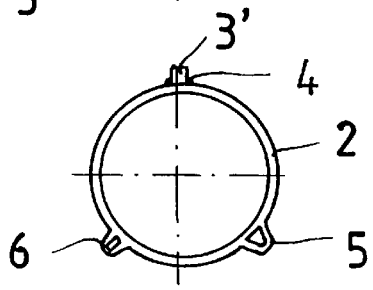
FIGS. 3, 4 and 5 are top plan views of three variants of the cylinder liner according to the invention.

As shown in FIG. 3 the ribs are formed by separate shaped rods 4, 5, 6 that are, for example, welded to the cylinder wall 2, The rods may have different cross-sectional shapes; they may be, for example, triangular rods 5 or rectangular rods 4, 6.

After being connected to the cylinder wall 2, the rods can additionally be spray-coated to obtain ribs having an embedded core.

Figure 4:
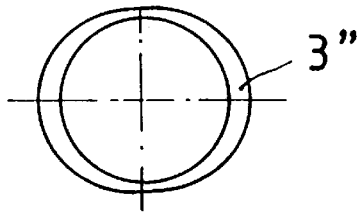
Figure 5:
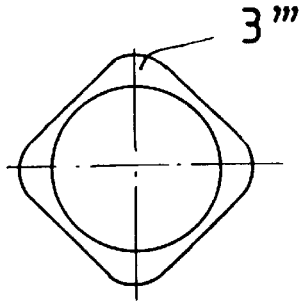

FIGS. 4 and 5 disclose further alternative embodiments of the invention. The thickened wall portions 3", 3'" are diametrically opposite, and are either obtained by a spraying technique or by machining of the cylinder wall, for example by out-of-round turning on a lathe.

According to a method of making the cylinder liner according to the invention, a thermal spraying tool and a mandrel are rotated relative to one another such that the spraying tool is orbiting about the mandrel by rotating the mandrel and/or the spraying tool first with a constant speed until a layer of the desired uniform wall thickness is built up. Thereafter a relative rotation of periodically inconstant speed is effected to form circumferentially spaced, axially extending thickened wall portions. Or, after obtaining the layer of the desired uniformly thickness, the above-described rods are secured to the outer face of the layer and thereafter the rods may be coated (thermally sprayed) with the liner material.

It will be understood that the above description of the present invention is susceptible to various modifications, changes and adaptations, and the same are intended to be comprehended within the meaning and range of equivalents of the appended claims.

What is claimed is:

1. A method of making a cylinder liner comprising the following steps:

(a) providing a spraying tool and a mandrel;

(b) effecting a first relative rotation of said spraying tool about said mandrel at a constant speed;

(c) thermally spraying a liner material on said mandrel with said spraying tool during step (b) for forming a layer of a predetermined wall thickness; and (d) upon completion of step (c) discontinuing step (b) and effecting a second relative rotation of said spraying tool about said mandrel at a periodically inconstant speed for forming thickened wall portions at circumferentially spaced locations.

* * * * *